US009314065B2

(12) United States Patent
Auger et al.

(10) Patent No.: US 9,314,065 B2
(45) Date of Patent: Apr. 19, 2016

(54) ARTICLE OF FOOTWEAR WITH BASE PLATE HAVING STRUCTURE AND STUDS

(75) Inventors: Perry W. Auger, Tigard, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 764 days.

(21) Appl. No.: 13/524,044

(22) Filed: Jun. 15, 2012

(65) Prior Publication Data

US 2013/0333248 A1 Dec. 19, 2013

(51) Int. Cl.

| | |
|---|---|
| ***A43B 3/00*** | (2006.01) |
| ***A43B 5/02*** | (2006.01) |
| ***A43B 13/26*** | (2006.01) |
| ***A43C 15/16*** | (2006.01) |

(52) U.S. Cl.

CPC ..... *A43B 3/0052* (2013.01); *A43B 5/02* (2013.01); *A43B 13/26* (2013.01); *A43C 15/16* (2013.01)

(58) Field of Classification Search

CPC ..... A43B 5/02; A43B 13/14; A43B 13/141; A43B 13/223; A43B 3/0052; A43C 15/16

USPC ..... 36/25 R, 59 R, 67 R, 67 A, 128

See application file for complete search history.

(56) References Cited

U.S. PATENT DOCUMENTS

| | | | | |
|---|---|---|---|---|
| 1,684,676 | A | 9/1928 | Lorenzi et al. | |
| 4,454,662 | A | 6/1984 | Stubblefield | |
| 4,782,604 | A | 11/1988 | Wen-Shown | |
| 5,461,801 | A | 10/1995 | Anderton | |
| 5,987,783 | A | 11/1999 | Allen et al. | |
| 6,442,872 | B1 | 9/2002 | Liao | |
| 7,143,530 | B2 | 12/2006 | Hudson et al. | |
| 7,441,350 | B2 | 10/2008 | Auger et al. | |
| 7,941,945 | B2 * | 5/2011 | Gerber | 36/59 R |
| 8,056,267 | B2 | 11/2011 | Auger et al. | |
| 8,082,686 | B2 | 12/2011 | Campbell et al. | |

(Continued)

FOREIGN PATENT DOCUMENTS

| | | |
|---|---|---|
| DE | 2927635 | 1/1981 |
| EP | 0103507 | 3/1984 |

(Continued)

OTHER PUBLICATIONS

International Preliminary Examination Report and Written Opinion for Application No. PCT/US2013/045565, mailed on Dec. 24, 2014.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear with a base plate having a structure and studs is disclosed. The structure may moderate stud pressure and enhance support during the first step of sprinting, quick directional changes, and backward movement. The structure may include a medial forefoot pad, a lateral forefoot pad connected to the medial forefoot pad, a medial heel pad, a first lateral heel pad connected to the medial heel pad, a first diagonal rib extending from the medial forefoot pad to the first lateral heel pad, a second diagonal rib extending from the lateral forefoot pad to the medial heel pad, a medial midfoot bar substantially parallel to the longitudinal axis and disposed proximate the medial edge, and a lateral midfoot bar substantially parallel to the longitudinal axis and disposed proximate the lateral edge.

12 Claims, 7 Drawing Sheets

(56) References Cited

U.S. PATENT DOCUMENTS

| | | | | |
|---|---|---|---|---|
| D688,037 | S * | 8/2013 | Dekovic et al. | D2/962 |
| 8,789,296 | B2 * | 7/2014 | Baker | 36/59 R |
| 2009/0235558 | A1 | 9/2009 | Auger et al. | |
| 2009/0293315 | A1 * | 12/2009 | Auger et al. | 36/114 |
| 2010/0050475 | A1 | 3/2010 | Benz | |
| 2010/0107450 | A1 | 5/2010 | Locke et al. | |
| 2010/0229427 | A1 | 9/2010 | Campbell et al. | |
| 2011/0088287 | A1 | 4/2011 | Auger et al. | |
| 2011/0214314 | A1 | 9/2011 | Baker et al. | |
| 2011/0289801 | A1 | 12/2011 | Amos et al. | |

FOREIGN PATENT DOCUMENTS

| | | | |
|---|---|---|---|
| JP | 2001-340101 | A | 12/2001 |
| JP | 2001340101 | | 12/2001 |
| JP | 2002-248006 | A | 9/2002 |
| JP | 2002-272506 | A | 9/2002 |
| JP | 2002-306207 | A | 10/2002 |
| JP | 3144588 | U | 8/2008 |
| JP | 2010099101 | | 5/2010 |
| JP | 2014-518751 | A | 8/2014 |
| JP | 5801959 | | 9/2015 |
| JP | 2015211923 | A | 11/2015 |
| WO | 8302715 | | 8/1983 |
| WO | 2007/138947 | A1 | 12/2007 |
| WO | 2013/188618 | A1 | 12/2013 |

OTHER PUBLICATIONS

English Translation of Japanese Office Action, issued Nov. 25, 2014, for JP Patent Application No. JP2014-521867.

Certified English Translation of Japanese Patent JP2001340101.

International Search Report and Written Opinion mailed Sep. 30, 2013 in International Application No. PCT/US2013/045565.

Notice of Allowance mailed Aug. 4, 2015 in Japanese Patent Application No. 2014-521867.

Office Action dated Aug. 10, 2015 in Chinese Patent Application No. 201380030407.2.

Voluntary Amendments filed Jun. 12, 2015 in Chinese Application No. 201380030407.2.

Response to Office Action filed Jan. 21, 2015 in Japanese Application No. 2014-521867.

Voluntary Amendments filed Jul. 20, 2015 in European Application No. 13742542.7.

Response to Office Action filed Dec. 24, 2015, in CN Application No. 201380030407.2.

* cited by examiner

ARTICLE OF FOOTWEAR WITH BASE PLATE HAVING STRUCTURE AND STUDS

BACKGROUND

The present invention relates generally to an article of footwear and, more particularly, to a sports shoe with cleats.

Articles of footwear having cleats have previously been proposed. While conventional cleats generally help give sports shoes more grip, the cleats do not necessarily optimize propulsion while stabilizing the wearer's foot. Moreover, the cleats do not always provide stability and responsiveness while also moderating stud pressure. It would be advantageous for a sports shoe to have cleats that optimize propulsion during the first step of sprinting and provide stability and responsiveness while also moderating stud pressure during quick directional changes.

SUMMARY

An article of footwear with a base plate having a structure and studs is disclosed. The structure may moderate stud pressure and enhance support during the first step of sprinting, quick directional changes, and backward movement.

In one aspect, the article of footwear may include a base plate including a forefoot region, a heel region, a longitudinal axis extending through the forefoot region and heel region, a forward edge, and a rearward edge. The article of foot wear may include a structure disposed on the base plate. The structure may include a medial forefoot pad disposed on the forefoot region proximate the midfoot portion and the medial edge, and a lateral forefoot pad disposed on the forefoot region proximate the midfoot portion and the lateral edge. The article of footwear may also include a medial heel pad disposed on the heel region proximate the medial edge, a first lateral heel pad disposed on the heel region proximate the lateral edge, a first diagonal rib extending from the medial forefoot pad to the first lateral heel pad, a second diagonal rib extending from the lateral forefoot pad to the medial heel pad, a medial midfoot bar substantially parallel to the longitudinal axis and disposed proximate the medial edge, and a lateral midfoot bar substantially parallel to the longitudinal axis and disposed proximate the lateral edge. The article of footwear may include a medial forefoot stud disposed on the medial forefoot pad. The article of footwear may include a medial heel stud disposed on the medial heel stud. The article of footwear may include a first lateral forefoot stud disposed on the lateral forefoot pad and a first lateral heel stud disposed on the first lateral heel pad. The medial midfoot bar may extend from a first point on the first diagonal rib to a second point on the second diagonal rib and the lateral midfoot bar may extend from a third point on the second diagonal rib to a fourth point on the first diagonal rib.

The structure may further comprise a heel rib disposed on the heel region and extending from the medial heel pad to the first lateral heel pad. The structure may further comprise a second lateral heel pad connected to the first lateral heel pad. The article of footwear may include a second lateral heel stud disposed on the second lateral heel pad. The medial heel pad may have a larger surface area than a base of the medial heel stud and the first lateral heel pad may have a larger surface area than a base of the first lateral heel stud. The article of footwear may include a second lateral forefoot stud disposed on the lateral forefoot pad. The medial forefoot pad may be connected to the lateral forefoot pad at a first point. The medial forefoot pad may taper in the direction of the lateral forefoot pad and the lateral forefoot pad may taper in the direction of the medial forefoot pad. The structure may include a center cleat disposed on the first point.

In another aspect, the article of footwear may comprise a base plate including a forefoot region, a heel region, a midfoot portion disposed between the forefoot region and the heel region, a longitudinal axis extending through the forefoot region and heel region, a forward edge, and a rearward edge. The article of footwear may include a structure disposed on the forefoot region of the base plate. The structure may include a first medial forefoot pad disposed proximate the forward edge and the medial edge, a second medial forefoot pad disposed proximate the forward edge and the lateral edge, a first lateral forefoot pad disposed proximate the midfoot portion and the medial edge, and a second lateral forefoot pad disposed proximate the midfoot portion and the lateral edge. The article of footwear may include a first medial forefoot stud disposed on the first medial forefoot pad. The article of footwear may include a second medial forefoot stud disposed on the second medial forefoot pad. The article of footwear may include a first lateral forefoot stud disposed on the first lateral forefoot pad. The article of footwear may include a second lateral forefoot stud disposed on the second lateral forefoot pad. The first medial forefoot pad may be connected to the first lateral forefoot pad at a first point. The first medial forefoot pad may taper in the direction of the first lateral forefoot pad and the first lateral forefoot pad tapering in the direction of the first medial forefoot pad. The structure may further comprise a first center cleat disposed on the first point. The first medial forefoot pad may have a larger surface area than a base of the first medial forefoot stud and the first lateral forefoot pad may have a larger surface area than a base of the first lateral forefoot stud. The structure may further comprise a third lateral forefoot stud disposed on the second lateral forefoot pad adjacent the second lateral forefoot stud.

The structure may further comprise a medial forefoot bar connecting the first medial forefoot pad to the second medial forefoot pad. The structure may further comprise a lateral forefoot bar connecting the first medial forefoot pad to the second lateral forefoot pad. The second medial forefoot pad may be connected to the second lateral forefoot pad at a second point. The second medial forefoot pad may taper in the direction of the second lateral forefoot pad and the second lateral forefoot pad may taper in the direction of the second medial forefoot pad. The structure may further comprise a second center cleat disposed on the second point.

In another aspect, the article of footwear may comprise a base plate including a forefoot region, a heel region, a midfoot portion disposed between the forefoot region and the heel region, a longitudinal axis extending through the forefoot region and heel region, a forward edge, and a rearward edge. The article of footwear may include a structure disposed on the base plate. The structure may include a first medial forefoot pad disposed proximate the forward edge and the medial edge, a second medial forefoot pad disposed proximate the forward edge and the lateral edge, a first lateral forefoot pad disposed on the forefoot region proximate the midfoot portion and the medial edge, a second lateral forefoot pad disposed on the forefoot region proximate the midfoot portion and the lateral edge, a medial forefoot bar extending from the first medial forefoot pad to the second medial forefoot pad, a lateral forefoot bar extending from the first lateral forefoot pad to the second lateral forefoot pad. The structure may also include a medial heel pad disposed on the heel region proximate the medial edge, a first lateral heel pad disposed on the heel region proximate the lateral edge, a first diagonal rib extending from the medial forefoot pad to the first lateral heel pad, a second diagonal rib extending from the lateral forefoot pad to the medial heel pad, a medial midfoot bar substantially parallel to the medial forefoot bar and disposed proximate the medial edge, and a lateral midfoot bar substantially parallel to the lateral forefoot bar and disposed proximate the lateral edge.

The article of footwear may further include a medial forefoot stud disposed on the medial forefoot pad. The article of footwear may further include a medial heel stud disposed on the medial heel stud. The article of footwear may further include a first lateral forefoot stud disposed on the lateral forefoot pad and a first lateral heel stud disposed on the first lateral heel pad. The medial midfoot bar may extend from a first point on the first diagonal rib to a second point on the second diagonal rib and the lateral midfoot bar may extend from a third point on the second diagonal rib to a fourth point on the first diagonal rib. The first medial forefoot pad may be connected to the first lateral forefoot pad at a fifth point. The structure may include a first center stud disposed on the fifth point. The second medial pad may be connected to the second lateral forefoot pad at a sixth point. The structure may include a second center stud disposed on the sixth point. The structure may further comprise a heel rib disposed on the heel region and extending from the medial heel pad to the first lateral heel pad. The structure may further comprise a second lateral heel pad disposed proximate the rearward edge and connected to the first lateral heel pad. The structure may include a second lateral heel stud disposed on the second lateral heel pad.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

An article of footwear with a base plate having a structure and studs is disclosed. FIGS. 1-7 illustrate an exemplary embodiment of a base plate 102. Base plate 102 may be associated with an article of footwear 100. The following detailed description discusses an exemplary embodiment in the form of a soccer shoe, but it should be noted that the present concept may be associated with any article of footwear, including, but not limited to, baseball shoes, rugby shoes, and football shoes. Article of footwear 100 shown in FIG. 1 may be intended to be used with a left foot. However, it should be understood that the following discussion may apply to a mirror image of article of footwear 100 that may be intended to be used with a right foot.

Figure 1:
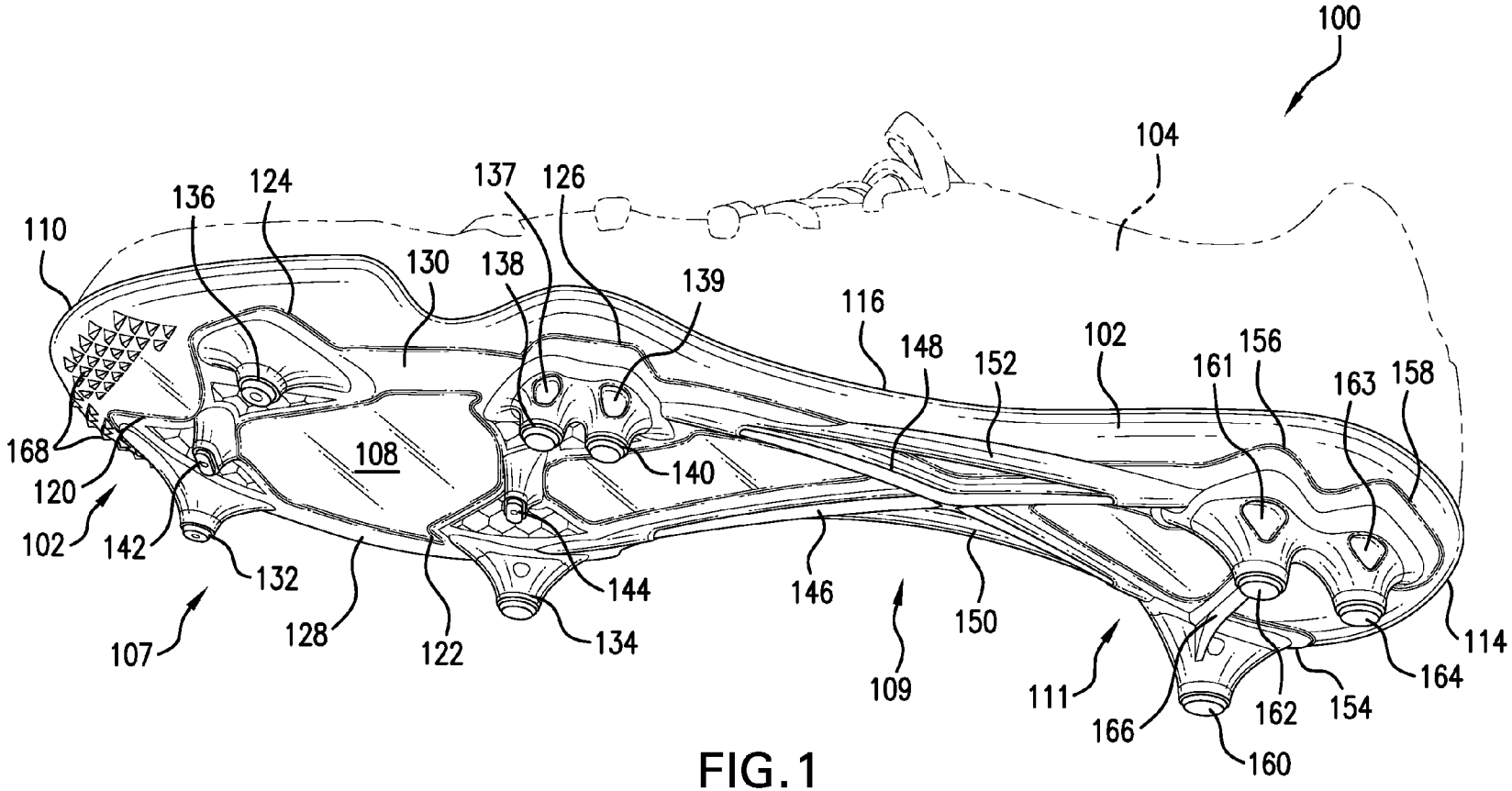
FIG. 1 is an isometric view of an exemplary embodiment of an article of footwear with a base plate with stud from a lateral side.
Figure 3:
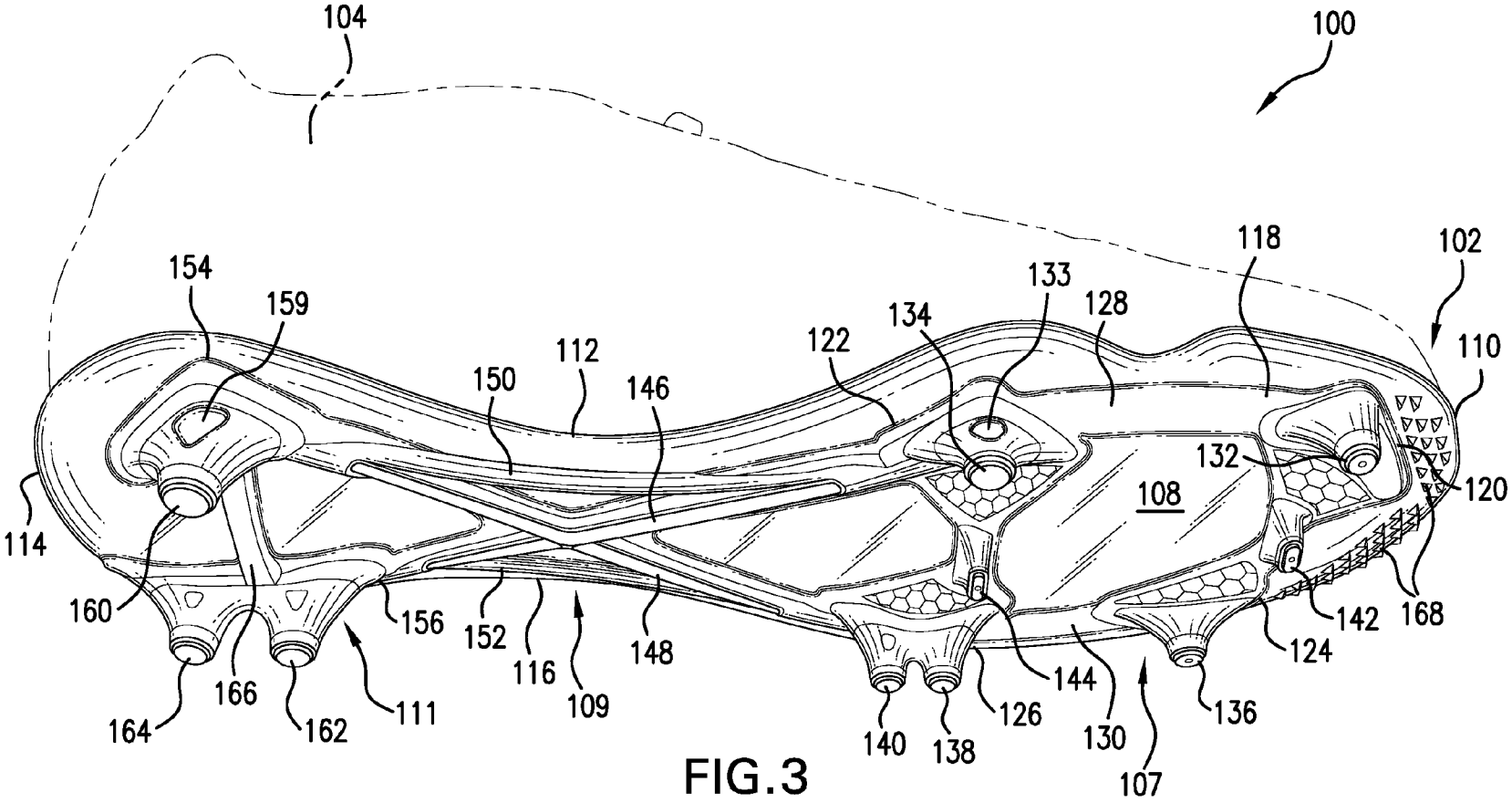
FIG. 3 is an isometric view of the exemplary embodiment of the article of footwear from a medial side.

In some embodiments, base plate 102 may be associated with an upper 104. FIGS. 1 and 3 show upper 104 in phantom lines. FIG. 1 is an isometric view of article of footwear 100 from a lateral side. FIG. 3 is an isometric view of article of footwear 100 from a medial side. Upper 104 may be attached to base plate 102 by any known mechanism or method. For example, upper 104 may be stitched to base plate 102 or upper 104 may be glued to base plate 102. Upper 104 may be configured to receive a foot. The exemplary embodiment shows a generic design for upper 104. In some embodiments, upper 104 may include another type of design.

Base plate 102 and upper 104 may be made from materials known in the art for making articles of footwear. For example, base plate 102 may be made from elastomers, siloxanes, natural rubber, synthetic rubbers, aluminum, steel, natural leather, synthetic leather, plastics, or thermoplastics. In another example, upper 104 may be made from nylon, natural leather, synthetic leather, natural rubber, or synthetic rubber.

Figure 2:
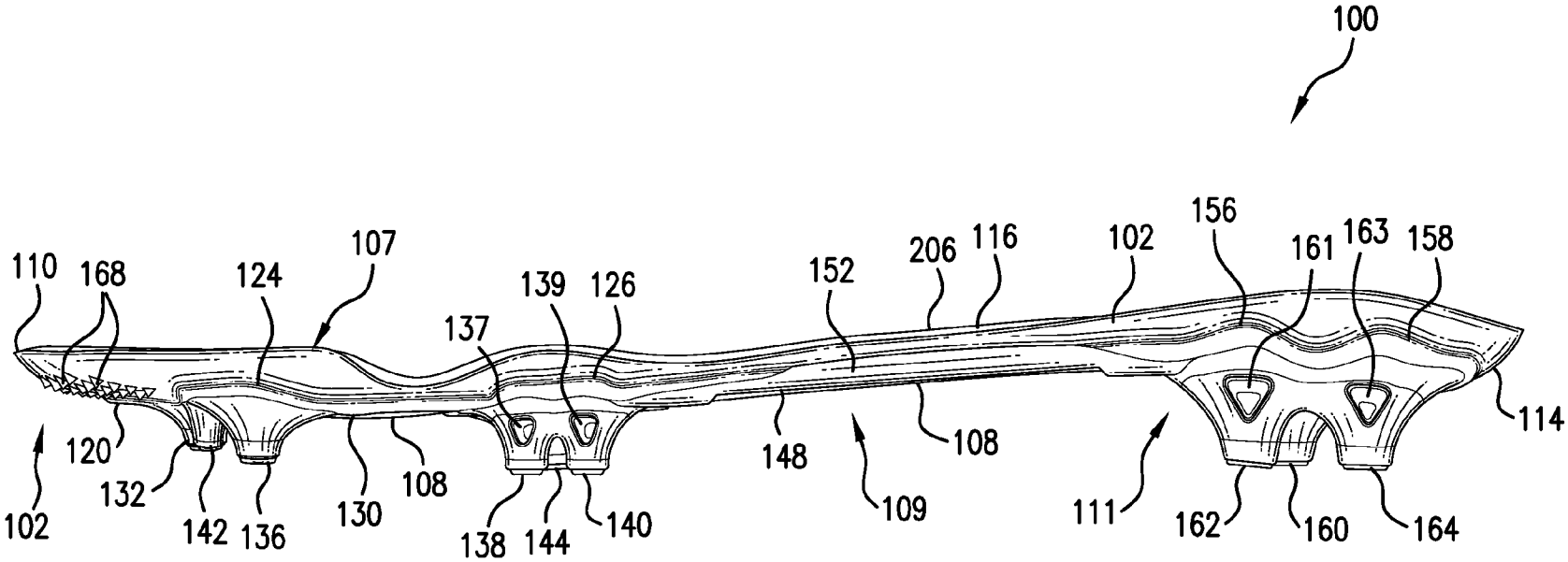
FIG. 2 is a side view of the exemplary embodiment of the base plate from the lateral side.
Figure 4:
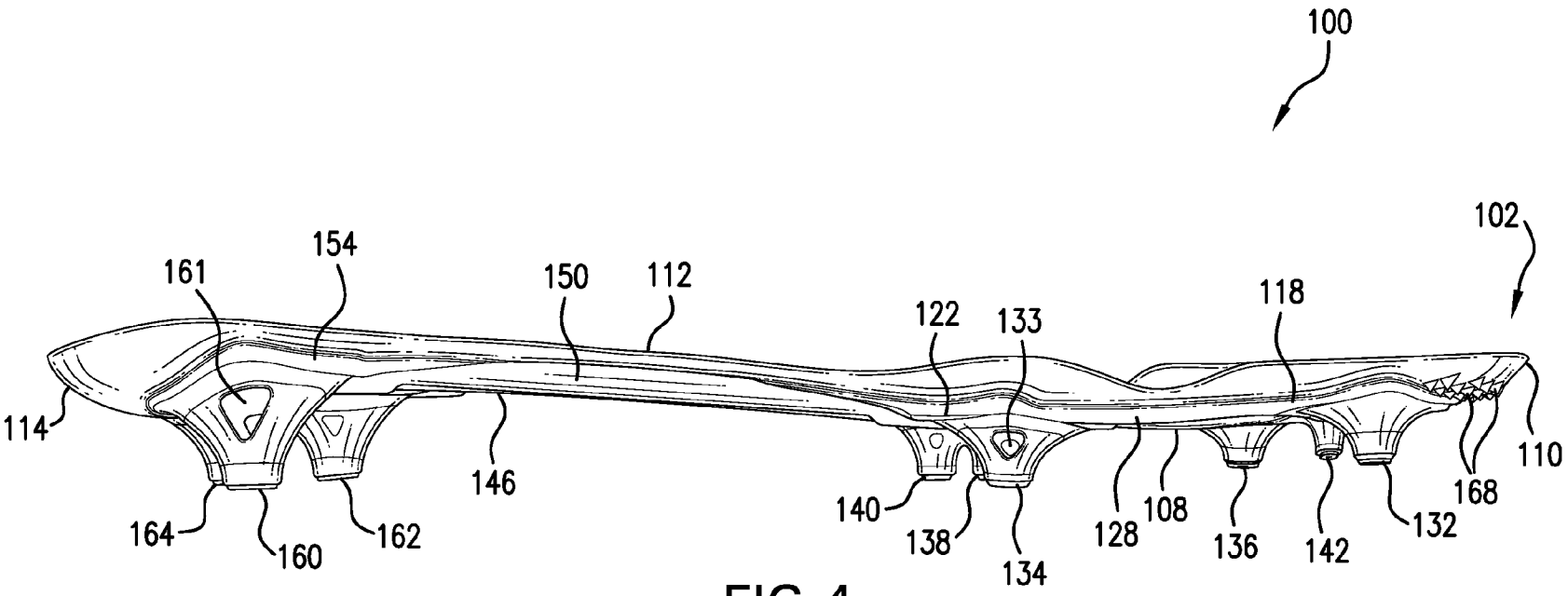
FIG. 4 is a side view of the exemplary embodiment of the base plate from the medial side.
Figure 5:
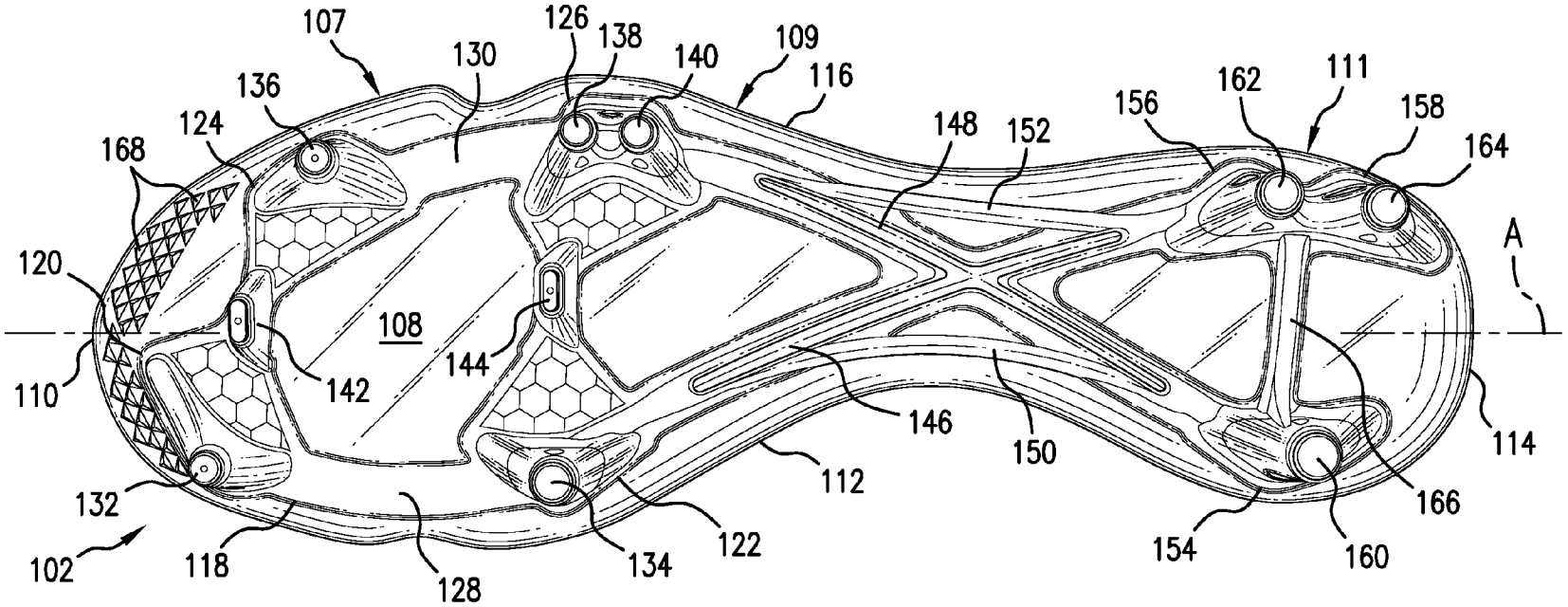
FIG. 5 is a plane view of a bottom surface of the exemplary embodiment of the base plate.

For clarity, base plate 102 is shown in isolation in FIGS. 2 and 4-7. FIG. 2 is a side view of base plate 102 from the lateral side. FIG. 4 is a side view of base plate 102 from the medial side. Base plate 102 may include a top surface 206 and a bottom surface 108. Base plate 102 may have a longitudinal axis A extending through the length of base plate 102 (FIG. 5). Base plate 102 may be configured to be attached to upper 104. Base plate 102 may also be configured to be attached to a midsole or an insole of an article of footwear. Top surface 206 may be configured to contact the midsole or the insole. Base plate 102 may include a forefoot region 107 disposed proximate a wearer's forefoot. Base plate 102 may include a heel region 111 disposed proximate a wearer's heel and opposite the forefoot region 107. Base plate 102 may include a midfoot region 109 disposed between forefoot region 107 and heel region 111. Base plate 102 may include a medial edge 112 and a lateral edge 116 opposite medial edge 112. The center region of base plate 102 may include the area proximate the halfway point between medial edge 112 and lateral edge 116. Base plate 102 may include a forward edge 110 and a rearward edge 114 disposed opposite forward edge 110.

Bottom surface 108 may be configured to contact a playing surface. For example, bottom surface 108 may be configured to contact grass, synthetic turf, dirt, or sand. Base plate 102 may include provisions for increasing traction with such a playing surface. For example, such provisions may include studs. The arrangement of studs may enhance traction for a wearer during cutting, turning, stopping, accelerating, and lateral movement. The studs are discussed in more detail below.

Base plate 102 may include components other than studs that contact a playing surface and increase traction. In some embodiments, base plate 102 may include traction elements that are smaller than studs. For example, base plate 102 may include teeth 168. Traction elements on base plate 102 may increase control for wearer when maneuvering forward on a surface by engaging surface. Additionally, traction elements may also increase the wearer's stability when making lateral movements by digging into playing surface. In some embodiments, traction elements may be molded into base plate 102. In some embodiments, base plate 102 may be configured to receive removable traction elements. As shown in FIGS. 1-6, teeth 168 may be disposed on forefoot region 107 along forward edge 110.

Base plate 102 may be a carrier plate for a structure 118. Structure 118 may act as a frame, or brace, for base plate 102. Structure 118 may be made of a stiffer, more responsive material than base plate 102 and may, thus, affect the movement of base plate 102. Structure 118 may be made from materials known in the art for making articles of footwear. For example, in some embodiments, base plate 102 may be made of renewable materials, such as Nylon 11, a polyamide bioplastic derived from vegetables. Structure 118 may moderate the pressure of studs disposed on base plate 102. In some embodiments, base plate 102 may be configured to receive removable studs. In other embodiments, base plate 102 may be associated with molded studs. For example, base plate 102 may be configured to receive molded studs. In another example, base plate 102 may include studs integrally formed with base plate 102 through molding. As shown in FIGS. 1 and 3, structure 118 may be raised with respect to base plate 102. In other embodiments, some or all of structure 118 may be flush with base plate 102.

The studs may be made from materials known in the art for making articles of footwear. For example, the studs may be made from elastomers, siloxanes, natural rubber, synthetic rubbers, aluminum, steel, natural leather, synthetic leather, plastics, or thermoplastics. In some embodiments, the studs may be made of the same materials. In other embodiments, the studs may be made of various materials. For example, one stud may be made of aluminum while another stud is made of a thermoplastic material. In some embodiments, the studs may have the same shape. In other embodiments, the stud may have different shapes. For example, the exemplary embodiment shown in FIGS. 1-7 illustrates studs of different shapes. In some embodiments, the studs may have the same height, width, and/or thickness. In other embodiments, the studs may have different heights, different widths, and/or different thicknesses.

In some embodiments, structure 118 may be disposed on the forefoot region 107 of base plate 102. In other embodiments structure 118 may be disposed on the heel region 111 of base plate 102. In some embodiments, structure 118 may be disposed on the midfoot region 109 of base plate 102. In yet other embodiments, structure 118 may be disposed on two or more of forefoot region 107, midfoot region, and heel region 111 of base plate 102.

In some embodiments, base plate 102 may be configured to receive structure 118. In some embodiments, base plate 102 may include a contoured surface providing recesses into which structure 118 may be received. In some embodiments, a portion of structure 118 disposed on forefoot region 107 may include a first medial forefoot pad 120, a second medial forefoot pad 122, a first lateral forefoot pad 124, a second lateral forefoot pad 126, a medial forefoot bar 128 and a lateral forefoot bar 130. In some embodiments, a portion of structure 118 disposed between forefoot region 107 and rearward edge 114 may include a first diagonal rib 146, a second diagonal rib 148, a medial midfoot bar 150, a lateral midfoot bar 152, a medial heel pad 154, a first lateral heel pad 156, and a second lateral heel pad 158. In some embodiments, structure 118 may be provided as a one-piece integral component.

First medial forefoot pad 120 may be disposed on forefoot region 107 proximate forward edge 110 and medial edge 112. First lateral forefoot pad 124 may be disposed on forefoot region 107 proximate forward edge 110 and lateral edge 116. First lateral forefoot pad 124 may be closer to forward edge 110 than first medial edge 112 is. First medial forefoot pad 120 may be connected to first lateral forefoot pad 124. In some embodiments, first medial forefoot pad 120 may taper in the direction of lateral edge 116. In some embodiment, first medial forefoot pad 120 may taper in the direction of first lateral forefoot pad 124. In some embodiments, first lateral forefoot pad 124 may taper in the direction of medial edge 112. In some embodiment, first lateral forefoot pad 124 may taper in the direction of first medial forefoot pad 120. The size, shape, and/or location of first medial forefoot pad 120 and/or first lateral forefoot pad 124 may be selected based on a variety of factors. For example, the size, shape, and/or location of first medial forefoot pad 120 may be selected to provide a certain degree of stiffness in base plate 102 and/or to provide a certain degree of pressure. First medial forefoot pad 120 and first lateral forefoot pad 124 may taper to the point where first medial forefoot pad 120 and first lateral forefoot pad 124 connect such that base plate 102 maintains flexibility at this point. Such a configuration may provide side-to-side flexibility.

In some embodiments, a first medial forefoot stud 132 may be disposed on first medial forefoot pad 120. In some embodiments, a first lateral forefoot stud 136 may be disposed on first lateral forefoot pad 124. The size, shape, and/or location of first medial forefoot stud 132 and/or first lateral forefoot pad 124 may be selected based on a variety of factors. For example, the size, shape, and/or location of first medial forefoot stud 132 may be selected to provide a certain amount of penetration during toe-off. In some embodiments, first medial forefoot pad 120 may have a surface area that is larger than a base of first medial forefoot stud 132. In some embodiments, the size, shape, and/or location of the base of first medial forefoot stud 132 may be selected based on the size, shape, and location of first medial forefoot pad 120. First medial forefoot stud 132 may taper from the base to a tip to provide stability in the base and enhanced penetration in the tip. First medial forefoot stud 132 may have a circular tip. In some embodiments, first lateral forefoot pad 124 may have a surface area that is larger than a base of first lateral forefoot stud 136. In some embodiments, the size, shape, and/or location of the base of first lateral forefoot stud 136 may be selected based on the size, shape, and location of first lateral forefoot pad 124. First lateral forefoot stud 136 may taper from the base to a tip to provide stability in the base and enhanced penetration in the tip. First lateral forefoot stud 136 may have a circular tip.

Second medial forefoot pad 122 may be disposed on forefoot region 107 proximate midfoot region 109 and medial edge 112. Second lateral forefoot pad 126 may be disposed on forefoot region 107 proximate midfoot region 109 and lateral edge 116. Second medial forefoot pad 122 may be connected to second lateral forefoot pad 126. In some embodiments, second medial forefoot pad 122 may taper in the direction of lateral edge 116. In some embodiment, second medial forefoot pad 122 may taper in the direction of second lateral forefoot pad 126. In some embodiments, second lateral forefoot pad 126 may taper in the direction of medial edge 112. In some embodiment, second lateral forefoot pad 126 may taper in the direction of second medial forefoot pad 122. The size, shape, and/or location of second medial forefoot pad 122 and/or second lateral forefoot pad 126 may be selected based on a variety of factors. For example, the size, shape, and/or location of second medial forefoot pad 122 may be selected to provide a certain degree of stiffness in base plate 102 and/or to provide a certain degree of pressure. Second medial forefoot pad 122 and second lateral forefoot pad 126 may taper to the point where second medial forefoot pad 122 and second lateral forefoot pad 126 connect such that base plate 102 maintains flexibility at this point. Such a configuration may provide side-to-side flexibility.

In some embodiments, a second medial forefoot stud 134 may be disposed on second medial forefoot pad 122. In some embodiments, a second lateral forefoot stud 138 may be disposed on second lateral forefoot pad 126. In some embodiments, a third lateral forefoot stud 140 may optionally be disposed on second lateral forefoot pad 126. The size, shape, and/or location of second medial forefoot stud 134, second lateral forefoot stud 138, and/or third lateral forefoot stud 140 may be selected based on a variety of factors. For example, the size, shape, and/or location of second medial forefoot stud 134 may be selected to provide a certain amount of penetration during toe-off. In another example, the size, shape, and/or location of second lateral forefoot stud 138 and third lateral forefoot stud 140 may be selected to provide stability and to enhance traction on the lateral side of the wearer's foot during lateral movement. In some embodiments, second medial forefoot stud 134 may include an aperture 133, second lateral forefoot stud 138 may include an aperture 137, and/or third lateral forefoot stud 140 may include an aperture 139. Aperture 133, aperture 137, and/or aperture 139 may include any of the features disclosed in Auger et al., U.S. patent publication number 2009/0235558, entitled Cleat Member for Article of Footwear, published on Sep. 24, 2009, the entirety of which is hereby incorporated by reference. In some embodiments, second lateral forefoot stud 138 and third lateral forefoot stud 140 may be aligned with each other a direction that is substantially parallel to lateral midfoot bar 152. In some embodiments, second medial forefoot pad 122 may have a surface area that is larger than a base of second medial forefoot stud 134. In some embodiments, the size, shape, and/or location of the base of second medial forefoot stud 134 may be selected based on the size, shape, and location of second medial forefoot pad 122. Second medial forefoot stud 134 may taper from the base to a tip to provide stability in the base and enhanced penetration in the tip. Second medial forefoot stud 134 may have a circular tip.

As shown in the drawings, in some embodiments, second lateral forefoot stud 138 and third lateral forefoot stud 140 may be joined at their bases such that the two studs share a single base. In some embodiments, second lateral forefoot pad 126 may have a surface area that is larger than the base of second lateral forefoot stud 138 and third lateral forefoot stud 140. In some embodiments, the size, shape, and/or location of the base of second lateral forefoot stud 138 and/or third lateral forefoot stud 140 may be selected based on the size, shape, and location of second lateral forefoot pad 126. Second lateral forefoot stud 138 may taper from the base to a tip to provide stability in the base and enhanced penetration in the tip. Second lateral forefoot stud 138 may have a circular tip. Third lateral forefoot stud 140 may taper from the base to a tip to provide stability in the base and enhanced penetration in the tip. Third lateral forefoot stud 140 may have a circular tip. In some embodiments, second lateral forefoot stud 138 and third lateral forefoot stud 140 may each have their own individual base. In such embodiments, the individual bases may be connected to one another.

In some embodiments, a first center stud 142 may be disposed on the center region of forefoot region 107. In some embodiments, first center stud 142 may be disposed on the point where first medial forefoot pad 120 and first lateral forefoot pad 124 connect. First center stud 142 may provide traction during forward movement. In some embodiments, the size, shape, and/or location of the base of first center stud 142 may be selected based on a variety of factors. For example, the size, shape, and/or location of the base of first center stud 142 may be selected based on the size of the point where first medial forefoot pad 120 and first lateral forefoot pad 124 connect. The size of the base of first center stud 142 may be the same as the surface area of the point. The width of first center stud 142 may taper from the base to a tip to provide stability in the base and enhanced penetration in the tip. First center stud 142 may have a constant thickness that is thin relative to the width of first center stud 142.

In some embodiments, a second center stud 144 may be disposed on the center region of forefoot region 107. In some embodiments, second center stud 144 may be disposed on the point where second medial forefoot pad 122 and second lateral forefoot pad 126 connect. In some embodiments, second center stud 144 may substantially align with first center stud 142 along the center region of base plate 102. In some embodiments, second center stud 144 may be slightly offset from first center stud 142 along the center region of base plate 102. Second center stud 144 may provide traction during forward movement. In some embodiments, the size, shape, and/or location of the base of second center stud 144 may be selected based on a variety of factors. For example, the size, shape, and/or location of the base of second center stud 144 may be selected based on the size of the point where second medial forefoot pad 122 and second lateral forefoot pad 126 connect. The size of the base of second center stud 144 may be the same as the surface area of the point. The width of second center stud 144 may taper from the base to a tip to provide stability in the base and enhanced penetration in the tip. In some embodiments, second center stud 144 may have a constant thickness that is thin relative to the width of second center stud 144.

Medial forefoot bar 128 may extend from first medial forefoot pad 120 to second medial forefoot pad 122 such that medial forefoot bar 128 connects first medial forefoot pad 120 to second medial forefoot pad 122. Medial forefoot bar 128 may be disposed proximate medial edge 112. Medial forefoot bar 128 may extend in a direction that is substantially parallel to the portion of medial edge 112 that medial forefoot bar 128 is proximate. Medial forefoot bar 128 may extend in a direction that is substantially parallel to longitudinal axis A. In some embodiments, medial forefoot bar 128 may be substantially straight. As shown in FIG. 5, in some embodiments, medial forefoot bar 128 may be slightly curved to follow the curvature of medial edge 112. The size, shape, and/or location of medial forefoot bar 128 may be selected based on a variety of factors. For example, the size, shape, and/or location of medial forefoot bar 128 may be selected to provide a certain amount of stiffness to base plate 102 while maintaining a certain level of flexibility. As shown in FIGS. 1-7, medial forefoot bar 128 may be thin and wide. As also shown in FIGS. 1-7, medial forefoot bar 128 may have a flat profile and may be substantially flush with base plate 102 on both top surface 206 and bottom surface 108.

Lateral forefoot bar 130 may extend from first lateral forefoot pad 124 to second lateral forefoot pad 126 such that lateral forefoot bar 130 connects first lateral forefoot pad 124 to second lateral forefoot pad 126. Lateral forefoot bar 130 may be disposed proximate lateral edge 116. Lateral forefoot bar 130 may extend in a direction that is substantially parallel to the portion of lateral edge 116 that lateral forefoot bar 130 is proximate. Lateral forefoot bar 130 may extend in a direction that is substantially parallel to longitudinal axis A. In some embodiments, lateral forefoot bar 130 may be substantially straight. As shown in FIG. 5, in some embodiments, lateral forefoot bar 130 may be slightly curved to follow the curvature of lateral edge 116. The size, shape, and/or location of lateral forefoot bar 130 may be selected based on a variety of factors. For example, the size, shape, and/or location of lateral forefoot bar 130 may be selected to provide a certain amount of stiffness to base plate 102 while maintaining a certain level of flexibility. As shown in FIGS. 1-7, lateral forefoot bar 130 may be thin and wide. As also shown in FIGS. 1-7, lateral forefoot bar 130 may have a flat profile and may be substantially flush with base plate 102 on both top surface 206 and bottom surface 108.

First medial forefoot pad 120, medial forefoot bar 128, second medial forefoot pad 122, second lateral forefoot pad 126, lateral forefoot bar 130, and first lateral forefoot pad 124 may be joined together and may lie proximate a perimeter of forefoot region 107. This configuration may cause the pressure applied by the weight of the wearer to be distributed among the studs disposed in forefoot region 107. Furthermore, this joining may provide stiffness and support within forefoot region 107. The size and shape of the pads relative to the size and shape of the studs in forefoot region 107 may aid in distributing the weight of the wearer among the studs. As shown in the drawings, the pads may have a larger surface area relative to other parts of the pads. The larger surface area of the pads may provide stiffness and the smaller surface area of the pads may provide flexibility. For example, the smallest surface area of first medial forefoot pad 120 and first lateral forefoot pad 124 may occur where the two pads connect. Similarly, the smallest surface area of second medial forefoot pad 122 and second lateral forefoot pad 126 may occur where the two pads connect. The smallest surface area of these four pads may align along the center of forefoot region 107 to provide flexibility along the center of forefoot region 107. Such flexibility may aid in directional changes.

Figure 6:
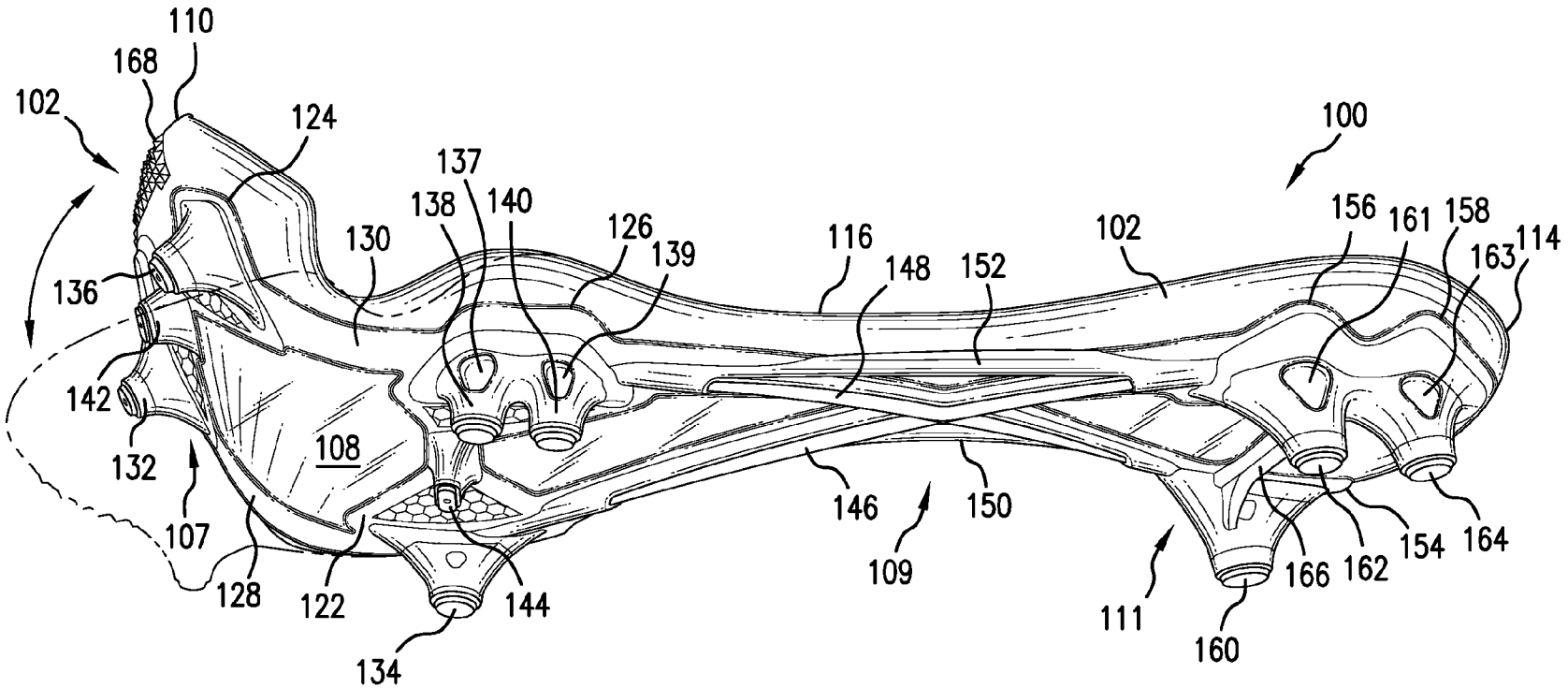
FIG. 6 is a view of the exemplary embodiment of the base plate bending in a forefoot region.

Medial forefoot bar 128 and lateral forefoot bar 120 may be substantially parallel to one another. FIG. 6 shows base plate 102 in a first position shown in solid lines. In the first position, forefoot region 107 is bent. This first position may occur when a wearer is pushing off the ground with her forefoot. FIG. 6 shows a second position in dotted lines. The second position may occur when a wearer's foot is flat against the ground before or after pushing off the ground with her forefoot. The arrow shows the directions in which forefoot region 107 may be bent. In the embodiment shown in the FIGS. 1-7, medial forefoot bar 128 and lateral forefoot bar 120 may both be thin such that forefoot region 107 may bend into the position shown in solid lines in FIG. 6. In the embodiment shown in the FIGS. 1-7, medial forefoot bar 128 and lateral forefoot bar 120 may be thin such that structure 118 bends with the wearer's foot along the metatarsophalangeal joints. However, medial forefoot bar 128 and lateral forefoot bar 120 may also both be wide such that forefoot region 107 may be resilient such that structure 118 snaps back into the position shown in dotted lines in FIG. 6. Such resiliency creates a cantilever effect that adds to the propulsion created when the wearer pushes off forefoot region 107. As discussed in more detail below, the ribs and bars disposed on midfoot region 109 add stiffness to midfoot region 109. This stiffness causes a resistance to bending in midfoot region 109. Thus, pressure applied to structure 118 may cause structure 118 to bend in forefoot region 107, but the stiffness of midfoot region 109 may help resist bending in response to the applied pressure.

Medial heel pad 154 may be disposed on heel region 111 proximate medial edge 112 and rearward edge 114. First lateral heel pad 156 may be disposed on heel region 111 proximate lateral edge 116. Second lateral heel pad 158 may be disposed on heel region 111 proximate lateral edge 116 and rearward edge 114. Second lateral heel pad 158 may be disposed between first lateral heel pad 156 and rearward edge 114. First lateral heel pad 156 and second lateral heel pad 156 may be aligned in a direction that is substantially parallel to lateral midfoot bar 152. First lateral heel pad 156 may be connected to second lateral heel pad 158. In some embodiments, first lateral heel pad 156 may taper toward forward edge 110 and toward rearward edge 114. In some embodiments, second lateral heel pad 158 may taper toward forward edge 110 and toward rearward edge 114. First lateral heel pad 156 may be connected to second lateral heel pad 158 at a point where both lateral heel pads taper such that the lateral heel pads have enhanced flexibility at the point of connection.

In some embodiments, a medial heel stud 160 may be disposed on medial heel pad 154. In some embodiments, a first lateral heel stud 162 may be disposed on first lateral heel pad 124. In some embodiments, a second lateral heel stud 164 may optionally be disposed on second lateral heel pad 158. The size, shape, and/or location of medial heel stud 160, first lateral heel stud 162, and/or second lateral heel stud 164 may be selected based on a variety of factors. For example, the size, shape, and/or location of medial heel stud 160 may be selected to provide a certain amount of traction during backward movement. In another example, the size, shape, and/or location of first lateral heel stud 162 and second lateral heel stud 164 may be selected to provide stability and to enhance traction on the lateral side of the wearer's foot during lateral movement. In some embodiments, medial heel stud 160 may include an aperture 159, first lateral heel stud 162 may include an aperture 161, and/or second lateral heel stud 164 may include an aperture 163. Aperture 159, aperture 161, and/or aperture 163 may include any of the features disclosed in Auger et al., U.S. patent publication number 2009/0235558, entitled Cleat Member for Article of Footwear, published on Sep. 24, 2009, the entirety of which is hereby incorporated by reference. In some embodiments, first lateral heel stud 162 and second lateral heel stud 164 may be aligned with each other a direction that is substantially parallel to lateral midfoot bar 152. In some embodiments, first lateral heel stud 162 and second lateral heel stud 164 may be aligned with each other a direction that is substantially parallel to the direction in which second lateral forefoot stud 138 and second lateral forefoot stud 140 are aligned with each other. In some embodiments, medial heel pad 154 may have a surface area that is larger than a base of medial heel stud 160. In some embodiments, the size, shape, and/or location of the base of medial heel stud 160 may be selected based on the size, shape, and location of medial heel pad 154. Medial heel stud 160 may taper from the base to a tip to provide stability in the base and enhanced penetration in the tip. Medial heel stud 160 may have a circular tip.

As shown in the drawings, in some embodiments, first lateral heel stud 162 and second lateral heel stud 164 may be disposed on their own pads and have their own bases. In other embodiments, first lateral heel stud 162 and second lateral heel stud 164 may be joined at their bases such that the two studs share a single base. In some embodiments, first lateral heel pad 156 may have a surface area that is larger than the base of first lateral heel stud 162. In some embodiments, second lateral heel pad 158 may have a surface area that is larger than the base of second lateral heel stud 164. In some embodiments, the size, shape, and/or location of the base of first lateral heel stud 162 and/or the base of second lateral heel stud 164 may be selected based on the size, shape, and location of first lateral heel pad 156 and/or second lateral heel pad 158. First lateral heel stud 162 may taper from the base to a tip to provide stability in the base and enhanced penetration in the tip. First lateral heel stud 162 may have a circular tip. Second lateral heel stud 164 may taper from the base to a tip to provide stability in the base and enhanced penetration in the tip. Second lateral heel stud 164 may have a circular tip.

Figure 7:
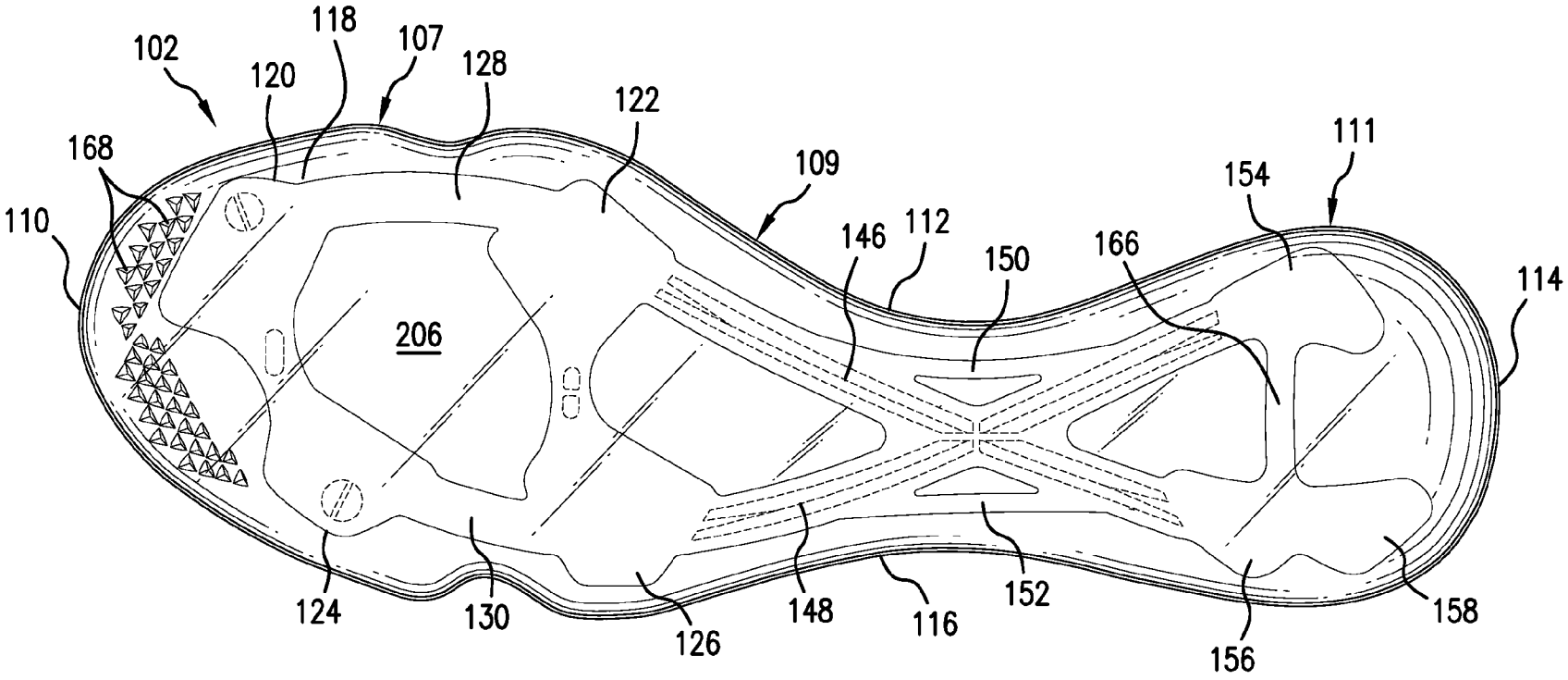
FIG. 7 is a plane view of a top surface of the exemplary embodiment of the base plate.

Heel rib 166 may connect medial heel pad 154 to first lateral heel pad 156. Heel rib 166 may connect medial heel pad 154 to second lateral heel pad 158. Heel rib 166 may extend from medial heel pad 154 to the point where first lateral heel pad 156 and second lateral heel pad 158 connect to one another. This connection may moderate stud pressure underneath medial heel stud 160 and first lateral heel stud 162 and second lateral heel stud 164. Heel rib 166 may extend in a direction that is substantially perpendicular to longitudinal axis A. Comparing the view from FIGS. 1, 3, and 5 with FIG. 7, it can be seen that heel rib 166 may be wider on top surface 206 of base plate 102 than on bottom surface 108 of base plate 102. As shown in FIG. 7, heel rib 166 may be flat on its top surface and may be substantially flush with top surface 206 of base plate 102. As shown in FIGS. 1, 3, and 5, a portion of heel rib 166 may be rounded on its bottom surface and may protrude from bottom surface 108 of base plate 102.

First diagonal rib 146 may extend between second medial forefoot pad 122 to first lateral heel pad 156. Comparing the view from FIGS. 1, 3, and 5 with FIG. 7, it can be seen that first diagonal rib 146 may be wider on top surface 206 of base plate 102 than on bottom surface 108 of base plate 102. As shown in FIG. 7, first diagonal rib 146 may be flat on its top surface and may be substantially flush with top surface 206 of base plate 102. As shown in FIGS. 1, 3, and 5, a portion of first diagonal rib 146 may be rounded on its bottom surface and may protrude from bottom surface 108 of base plate 102. The width of the portion of first diagonal rib 146 protruding from bottom surface 108 may increase toward the studs.

Second diagonal rib 148 may extend from second lateral forefoot stud 138 to medial heel pad 154. Comparing the view from FIGS. 1, 3, and 5 with FIG. 7, it can be seen that second diagonal rib 148 may be wider on top surface 206 of base plate 102 than on bottom surface 108 of base plate 102. As shown in FIG. 7, second diagonal rib 148 may be flat on its top surface and may be substantially flush with top surface 206 of base plate 102. As shown in FIGS. 1, 3, and 5, a portion of second diagonal rib 148 may be rounded on its bottom surface and may protrude from bottom surface 108 of base plate 102. The width of the portion of second diagonal rib 148 protruding from bottom surface 108 may increase toward the studs.

First diagonal rib 146 and second diagonal rib 148 may intersect in midfoot region 109 proximate the center region such that the two ribs form an X-shape. First diagonal rib 146 and second diagonal rib 148 may be connected at the intersection of the two ribs. The X-shaped configuration and the protruding profile of first diagonal rib 146 and second diagonal rib 148 may provide arch stiffness that supports the arch of the wearer's foot in bending. As shown by the dotted lines in FIG. 7, parts of the top surface of structure 118, including first diagonal rib 146 and second diagonal rib 148, may be hollow on the top surface to decrease the weight of structure 118.

Medial midfoot bar 150 may be disposed proximate medial edge 112. Medial midfoot bar 150 may be connected to both first diagonal rib 146 and second diagonal rib 148. One end of medial midfoot bar 150 may be connected to first diagonal rib 146 at a first point that is disposed between second medial forefoot pad 122 and the intersection of first diagonal rib 146 and second diagonal rib 148. The opposite end of medial midfoot bar 150 may be connected to second diagonal rib 148 at a second point that is disposed between medial heel pad 154 and the intersection of first diagonal rib 146 and second diagonal rib 148. In some embodiments, medial midfoot bar 150 may be substantially straight. As shown in FIG. 5, in some embodiments, medial midfoot bar 150 may be slightly curved. Medial midfoot bar 150 may extend in a direction that is substantially parallel to longitudinal axis A. Medial midfoot bar 150 may tie into first diagonal rib 146 and second diagonal rib 148 such that medial midfoot bar 150 extends between second medial forefoot pad 122 and medial heel pad 154. This placement may enhance stiffness between second medial forefoot pad 122 and medial heel pad 154 and may also moderate stud pressure underneath second medial forefoot stud 134 and medial heel stud 160. As shown in FIG. 7, medial midfoot bar 150 may be flat on its top surface and may be substantially flush with top surface 206 of base plate 102. As shown in FIGS. 1, 3, and 5, medial midfoot bar 150 may be rounded on its bottom surface and may protrude from bottom surface 108 of base plate 102.

Lateral midfoot bar 152 may be disposed proximate lateral edge 116. Lateral midfoot bar 152 may be connected to both first diagonal rib 146 and second diagonal rib 148. One end of lateral midfoot bar 152 may be connected to second diagonal rib 148 at a first point that is disposed between second lateral forefoot pad 124 and the intersection of first diagonal rib 146 and second diagonal rib 148. Another end of lateral midfoot bar 152 may be connected to first diagonal rib 146 at a second point that is disposed between first lateral heel pad 156 and the intersection of first diagonal rib 146 and second diagonal rib 148. In some embodiments, lateral midfoot bar 152 may be slightly curved. As shown in FIG. 5, in some embodiments, lateral midfoot bar 152 may be substantially straight. Lateral midfoot bar 152 may extend in a direction that is substantially parallel to longitudinal axis A. Lateral midfoot bar 152 and medial midfoot bar 150 may be substantially parallel to one another. Lateral midfoot bar 152 may tie into first diagonal rib 146 and second diagonal rib 148 such that lateral midfoot bar 152 extends between second lateral forefoot pad 126 and first lateral heel pad 156. This placement may enhance stiffness between second lateral forefoot pad 126 and first lateral heel pad 156 may also moderate stud pressure underneath second lateral forefoot stud 138, third lateral forefoot stud 140, and first lateral heel stud 162. In embodiments in which first lateral heel pad 156 is connected to second lateral heel pad 158, as shown in FIGS. 1-7, the placement of lateral midfoot bar 152 may also moderate stud pressure underneath second lateral heel stud 164. As shown in FIG. 7, lateral midfoot bar 152 may be flat on its top surface and may be substantially flush with top surface 206 of base plate 102. As shown in FIGS. 1, 3, and 5, lateral midfoot bar 152 may be rounded on its bottom surface and may protrude from bottom surface 108 of base plate 102. Together, medial midfoot bar 150 and lateral midfoot bar 152 may provide base plate 102 with torsional stiffness resisting twisting in midfoot region 109.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a base plate including a forefoot region, a heel region, a midfoot portion disposed between the forefoot region and the heel region, a longitudinal axis extending through the forefoot region and heel region, a forward edge, a rearward edge, a medial edge, and a lateral edge;

a structure disposed on the base plate, the structure including a medial forefoot pad disposed on the forefoot region proximate the midfoot portion and the medial edge, a lateral forefoot pad disposed on the forefoot region proximate the midfoot portion and the lateral edge, a medial heel pad disposed on the heel region proximate the medial edge, a first lateral heel pad disposed on the heel region proximate the lateral edge, a first diagonal rib extending from the medial forefoot pad to the first lateral heel pad, a second diagonal rib extending from the lateral forefoot pad to the medial heel pad, a medial midfoot bar substantially parallel to the longitudinal axis and disposed proximate the medial edge, and a lateral midfoot bar substantially parallel to the longitudinal axis and disposed proximate the lateral edge;

a medial forefoot stud disposed on the medial forefoot pad;

a medial heel stud disposed on the medial heel pad;

a first lateral forefoot stud disposed on the lateral forefoot pad; and a first lateral heel stud disposed on the first lateral heel pad;

the first diagonal rib having a first lateral edge intersecting with the first lateral heel pad;

the second diagonal rib having a second lateral edge intersecting with the first lateral forefoot pad;

the lateral midfoot bar having a third lateral edge;

wherein the medial midfoot bar extends from a first point on the first diagonal rib to a second point on the second diagonal rib; and wherein the third lateral edge of the lateral midfoot bar intersects with, and terminates at, a third point on the second diagonal rib at a forward end of the lateral midfoot bar;

wherein the third lateral edge of the lateral midfoot bar intersects with, and terminates at, a fourth point on the first diagonal rib at a rearward end of the lateral midfoot bar;

wherein the third point is spaced from the lateral forefoot pad; and wherein the fourth point is spaced from the first lateral heel pad.

2. The article of footwear according to claim 1, wherein the structure further includes a heel rib disposed on the heel region and extending from the medial heel pad to the first lateral heel pad.

3. The article of footwear according to claim 2, wherein the structure further comprises:

a second lateral heel pad connected to the first lateral heel pad.

4. The article of footwear according to claim 3, further comprising;

a second lateral heel stud disposed on the second lateral heel pad; and a second lateral forefoot stud disposed on the lateral forefoot pad.

5. The article of footwear according to claim 1, wherein the medial heel pad has a larger surface area than a base of the medial heel stud and the first lateral heel pad has a larger surface area than a base of the first lateral heel stud.

6. The article of footwear according to claim 1, the second point and the third point are both disposed on the second diagonal rib at a point located between the lateral forefoot pad and the medial heel pad, and the third point is closer to the lateral forefoot pad than is the second point.

7. The article of footwear according to claim 1, wherein the medial forefoot pad is connected to the lateral forefoot pad at a fifth point, the medial forefoot pad tapering in the direction of the lateral forefoot pad and the lateral forefoot pad tapering in the direction of the medial forefoot pad.

8. The article of footwear according to claim 7, wherein the structure further comprises a center cleat disposed on the fifth point.

9. An article of footwear comprising:

a base plate including a forefoot region, a heel region, a midfoot portion disposed between the forefoot region and the heel region, a longitudinal axis extending through the forefoot region and heel region, a forward edge, a rearward edge, a medial edge, and a lateral edge;

a structure disposed on the base plate, the structure including a first medial forefoot pad disposed proximate the forward edge and the medial edge, a second medial forefoot pad disposed on the forefoot region proximate the midfoot portion and the medial edge, a first lateral forefoot pad disposed on the forefoot region proximate the forward edge and the lateral edge, a second lateral forefoot pad disposed on the forefoot region proximate the midfoot portion and the lateral edge, a medial forefoot bar extending from the first medial forefoot pad to the second medial forefoot pad, a lateral forefoot bar extending from the first lateral forefoot pad to the second lateral forefoot pad, a medial heel pad disposed on the heel region proximate the medial edge, a first lateral heel pad disposed on the heel region proximate the lateral edge, a first diagonal rib extending from the second medial forefoot pad to the first lateral heel pad, a second diagonal rib extending from the second lateral forefoot pad to the medial heel pad, a medial midfoot bar substantially parallel to the medial forefoot bar and disposed proximate the medial edge, a lateral midfoot bar substantially parallel to the lateral forefoot bar and disposed proximate the lateral edge;

a medial forefoot stud disposed on the first medial forefoot pad;

a medial heel stud disposed on the medial heel pad;

a lateral forefoot stud disposed on the second lateral forefoot pad; and a first lateral heel stud disposed on the first lateral heel pad, wherein the medial midfoot bar extends from a first point on the first diagonal rib to a second point on the second diagonal rib and the lateral midfoot bar extends from a third point on the second diagonal rib to a fourth point on the first diagonal rib, wherein the second point is disposed on the second diagonal rib between the second lateral forefoot pad and the medial heel pad; and wherein a portion of the first diagonal rib extends independent of the lateral midfoot bar beyond the fourth point toward the lateral forefoot stud; and wherein a portion of the second diagonal rib extends independent of the lateral midfoot bar beyond the third point toward the first lateral heel stud.

10. The article of footwear according to claim 9, wherein the first medial forefoot pad is connected to the first lateral forefoot pad at a fifth point, the structure including a first center stud disposed on the fifth point, and wherein the second medial forefoot pad is connected to the second lateral forefoot pad at a sixth point, the structure including a second center stud disposed on the sixth point.

11. The article of footwear according to claim 9, wherein the structure further comprises a heel rib disposed on the heel region and extending from the medial heel pad to the first lateral heel pad.

12. The article of footwear according to claim 11, wherein the structure further comprises a second lateral heel pad disposed proximate the rearward edge and connected to the first lateral heel pad and a second lateral heel stud disposed on the second lateral heel pad, the second lateral heel stud sharing a base with the first lateral heel stud.

* * * * *